US006347909B1

(12) United States Patent
Kocaman

(10) Patent No.: US 6,347,909 B1
(45) Date of Patent: Feb. 19, 2002

(54) METHOD TO TRANSPORT AND INSTALL A DECK

(75) Inventor: Alp A. Kocaman, Houston, TX (US)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 09/576,697

(22) Filed: May 23, 2000

(51) Int. Cl.[7] ..... B63B 35/40; E02D 23/00

(52) U.S. Cl. ..... 405/209; 405/204; 405/205; 114/259

(58) Field of Search ..... 405/203, 204, 405/205, 206, 209; 114/258, 242, 259

(56) References Cited

U.S. PATENT DOCUMENTS 5,609,441 A * 3/1997 Khachaturian ..... 405/204
5,662,434 A * 9/1997 Khachaturian ..... 405/204
5,800,093 A * 9/1998 Khachaturian ..... 405/204
5,924,822 A * 7/1999 Finn et al. ..... 405/209
5,975,807 A * 11/1999 Khachaturian ..... 405/204

* cited by examiner

*Primary Examiner*—Robert E. Pezzuto
*Assistant Examiner*—Tara L. Mayo
(74) *Attorney, Agent, or Firm*—D. Neil LaHave; Rob Baraona; Eric Marich

(57) ABSTRACT

A method to transport a deck at sea and install the deck on an offshore substructure. The deck is completely fabricated on a set of deep girders. The deck and deep girders are skidded onto two pontoons. The deck and deep girders are tied down together. A set of jacking units is installed into the deep girders prior to sail out. The complete assembly is towed to the installation site. At the site, the tie downs are removed. The girders are jacked up and the pontoons simultaneously ballasted down until the assembly is supported on the pontoons. The deck is lowered onto the substructure and the pontoons released

3 Claims, 4 Drawing Sheets

METHOD TO TRANSPORT AND INSTALL A DECK

BACKGROUND OF THE INVENTION

1. Field of the Invention

The invention is generally related to construction of offshore structures and more particularly to the transport and installation of heavy decks offshore.

2. General Background

An extensive number of offshore structures have been placed on the sea floor around the world to produce oil and gas reserves commonly found on the Outer Continental Shelf. The platforms combine the substructure, which extends from the sea floor to an elevation above the sea level, and the deck structure, which houses all the equipment necessary for the operation of the platform. During the construction of the offshore platform a certain amount of offshore assembly is generally required. In order to minimize the offshore construction costs, the platforms are often subdivided into a few large components.

The substructure is normally fabricated as a single unit onshore, skidded onto a transport and/or launch barge, towed to the site, launched or lifted off from the barge, and placed on the sea floor by ballasting. Piling is driven into the sea floor through pile sleeves or other features in the substructure after which the piling is secured to the driven piling by grouting, welding, or other mechanical methods.

The function of the substructure is to support the superstructure, or the deck. The deck contains the equipment necessary for the operation of the platform. Ideally, the deck is built as a complete unit onshore with all of its equipment installed and tested. The deck is then skidded onto a transport barge, towed to offshore installation site, lifted by a high capacity floating crane, and mounted on a previously installed substructure. If the deck is too heavy to be lifted by the available barge-mounted floating crane, then it has to be installed by one of two methods described below.

The most common method is to subdivide the deck into smaller units that can be lifted by the floating crane. The separate units are fabricated onshore and the equipment in each of the units is tested to the extend possible. The units are skidded onto transport barges, towed to the offshore installation site, lifted by a floating crane and placed on the previously installed substructure, or on previously installed deck units. There are significant disadvantages to this method. It takes longer to lift and place several units instead of a single unit. The individual modules have to be able to match with each other. An extra amount of structure must be constructed. More significantly, it takes extra time to make necessary connections between the units and test all the equipment prior to production A method exists that permits the deck to be fabricated as a complete unit onshore with all its equipment installed and tested before it is skidded onto the transportation barge. For this method to be successful, the substructure is specially designed with a large open area in its central region near the waterline. The transport barge, with a deck onboard, is floated into this central region and moored with the deck in the mating position. In the mating position, legs extending downward from the deck are directly above legs projecting upward from the substructure on either side of the barge. The deck is mated to the substructure by ballasting the barge downward until it rests on the substructure legs.

This method permits the deck to be fabricated as a complete unit onshore and eliminates the use of floating cranes offshore. However, this method puts severe limits on the operation. A deck that can not be lifted by a floating crane is fairly massive. Such a deck will require a wide transportation barge so that it will be stable against roll. A wide barge requires an even larger opening in the central region of the substructure in which to fit the transport barge. Thus, this renders this method suitable for only wide decks and substructures. Also, the opening in the substructure causes a large span of deck between the support points, so the structural efficiency gained in the complete deck construction may be lost. The depth of the barge controls the height at which the deck is set. Most significantly, the time required to ballast the barge during set down operation is significant, requiring a long weather window for transfer operations. Also, the ballasting rate is such that there exists a possibility of damage to the deck due to the barge's heave motions.

SUMMARY OF THE INVENTION

The invention addresses the above need. What is provided is a method to transport a deck at sea and install the deck on an offshore substructure. The deck is completely fabricated on a set of deep girders. The deck and deep girders are skidded onto two pontoons. The deck and deep girders are tied down together. A set of jacking units is installed into the deep girders prior to sail out. The complete assembly is towed to the installation site. At the site, the tie downs are removed. The girders are jacked up and the pontoons simultaneously ballasted down until the assembly is supported on the pontoons. The deck is lowered onto the substructure and the pontoons released.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
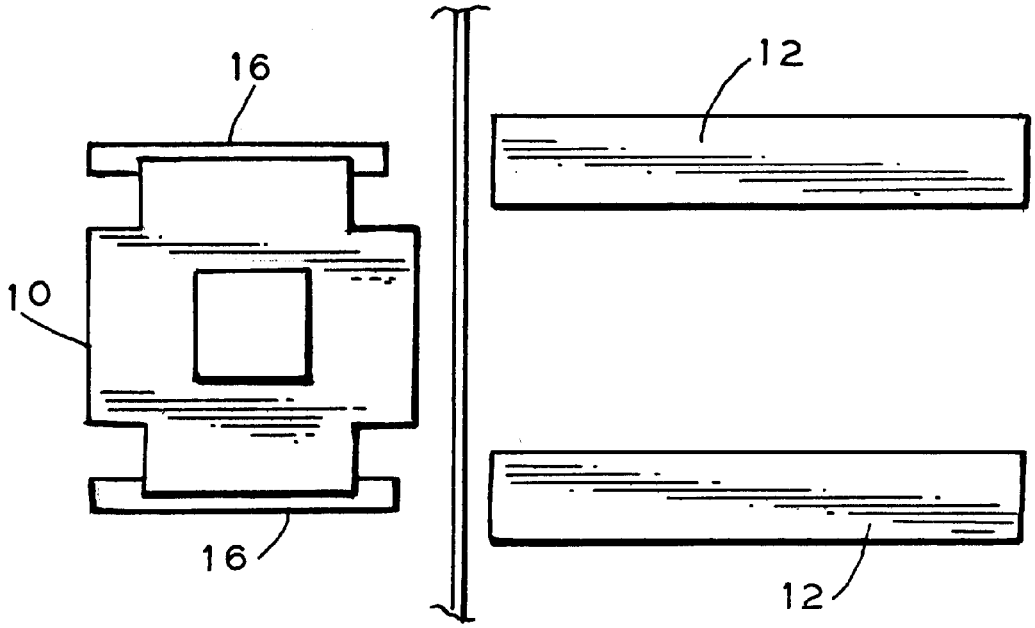
FIG. 1 is a plan view of a completed deck in a fabrication yard prior to skidding the deck onto pontoons.

FIG. 1 illustrates a completed deck 10 in a fabrication yard prior to skidding the deck 10 onto pontoons 12. The deck 10 is fabricated in proximity to the bulkhead 14. The pontoons 12 are moored with their stern adjacent the bulkhead 14.

Figure 2:
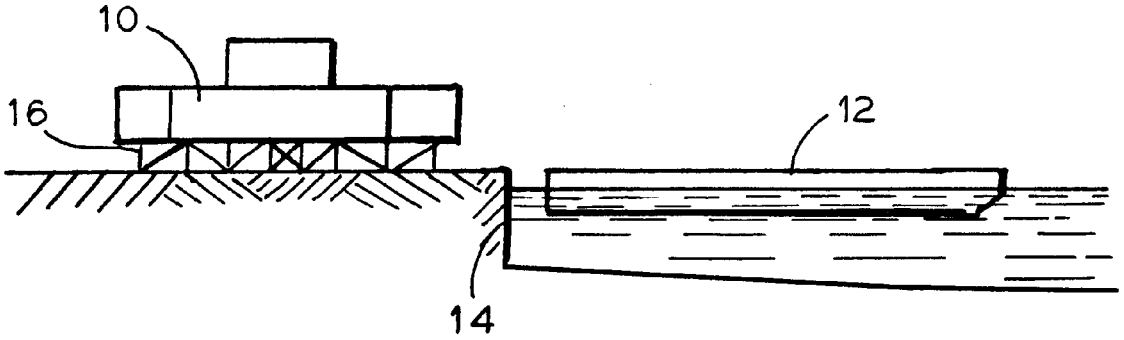
FIG. 2 is a side view that illustrates how the deck is supported in the fabrication yard.

As seen in FIG. 2, the deck 10 is fabricated on a lifting girder 16 that allows the heavy deck loads to be spread onto the ground. The lifting girder 16 is a special truss that supports the deck 10 during construction, is used to skid the deck 10 onto the pontoons 12, and is used to lift the deck 10 to the required height during deck installation offshore. After the deck 10 is completed, the lifting girders 16 are used to skid the deck 10 and lifting girders 16 onto the pontoons 12. As seen in FIG. 1, a lifting girder 16 is provided on at least two sides of the deck 10.

Figure 3:
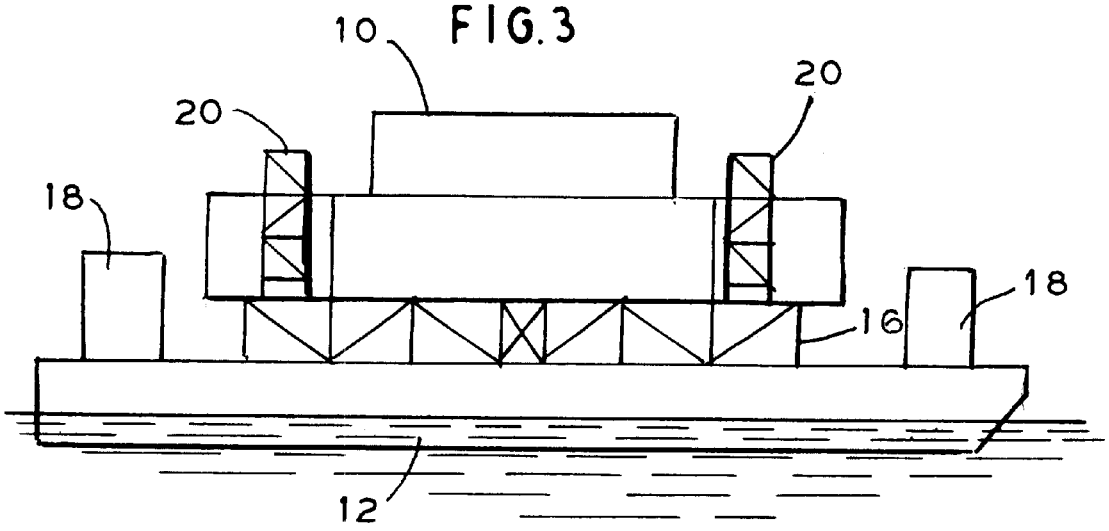
FIG. 3 illustrates the loaded deck under tow.

FIG. 3 illustrates the deck 10 and lifting girders 16 positioned on the pontoons 12. A stability column 18 has been secured at each end of the pontoon 12 by any suitable means such as welding. A lifting tower 20 has been secured at each end of the pontoons adjacent the lifting girders 16 by any suitable means such as welding.

Figure 4:
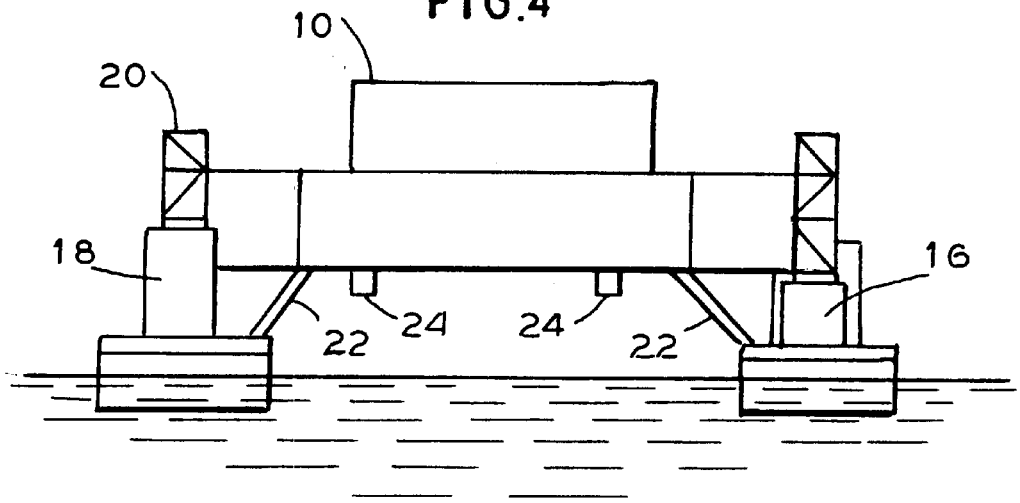
FIG. 4 is a bow view of the pontoons in tow configuration.

FIG. 4 is a bow view that illustrates the pontoons 12 in tow configuration. Lateral tie down bracing 22 has been secured between the deck 10 and each pontoon 12 to keep the deck tied to the pontoons and stable. The stabbing points 24 on the deck 10 are also visible.

Figure 5:
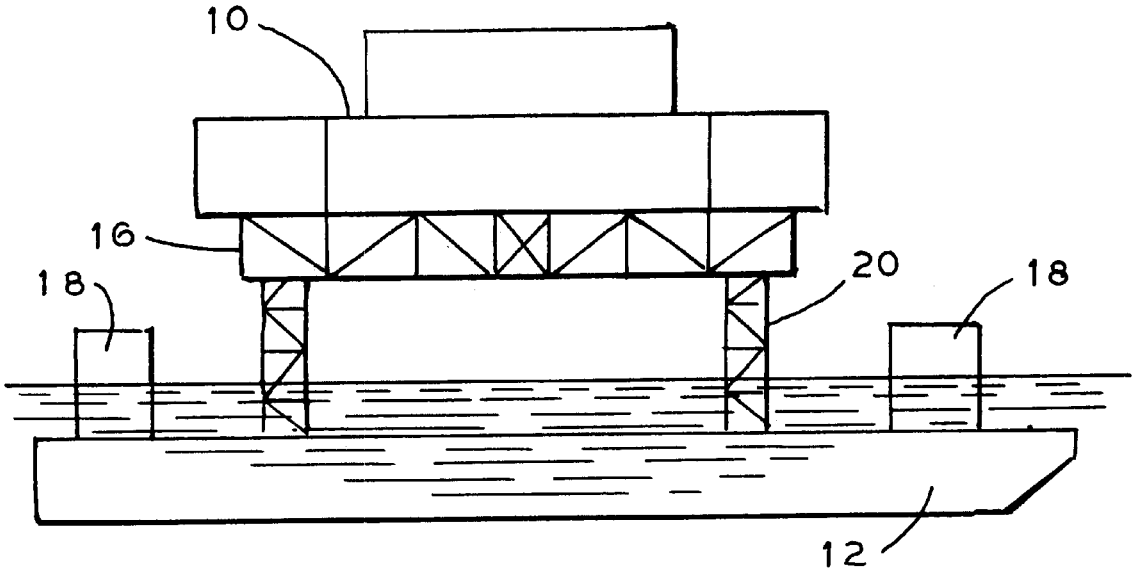
FIG. 5 illustrates the deck in a raised position.

Once at the installation site, the deck 10 is raised using the lifting girders 16 along lifting towers 20 while the pontoons 12 are ballasted down as seen in FIG. 5, after the lateral tie down bracing 22 is removed.

Figure 6:
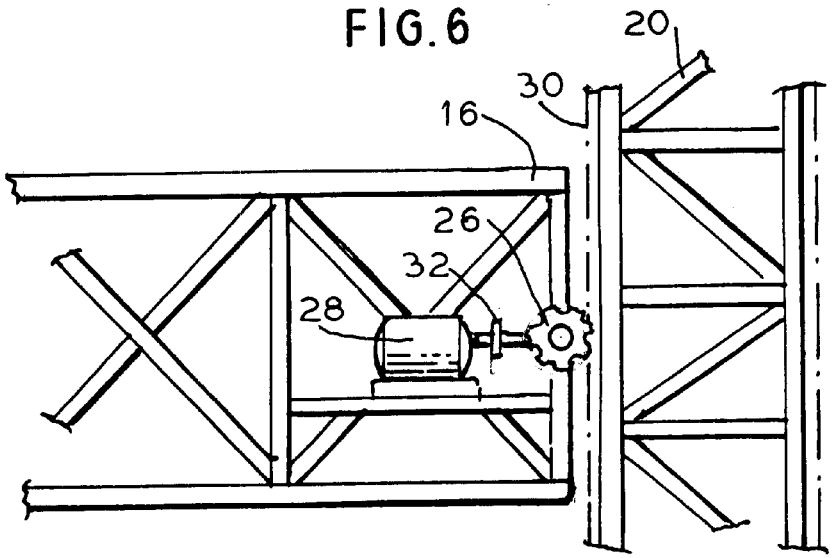
FIG. 6 illustrates the rack and pinion mechanism.

FIG. 6 illustrates a rack and pinion mechanism used to lift the deck 10. Pinions 26 provided in the lifting girders 16 are driven by electric motors 28. The pinions 26 act against a rack cut into the lifting tower chords 30. The electric motors 28 preferably include a fail safe brake mechanism 32 that is activated as the deck 10 is raised to the desired height.

Figure 7:
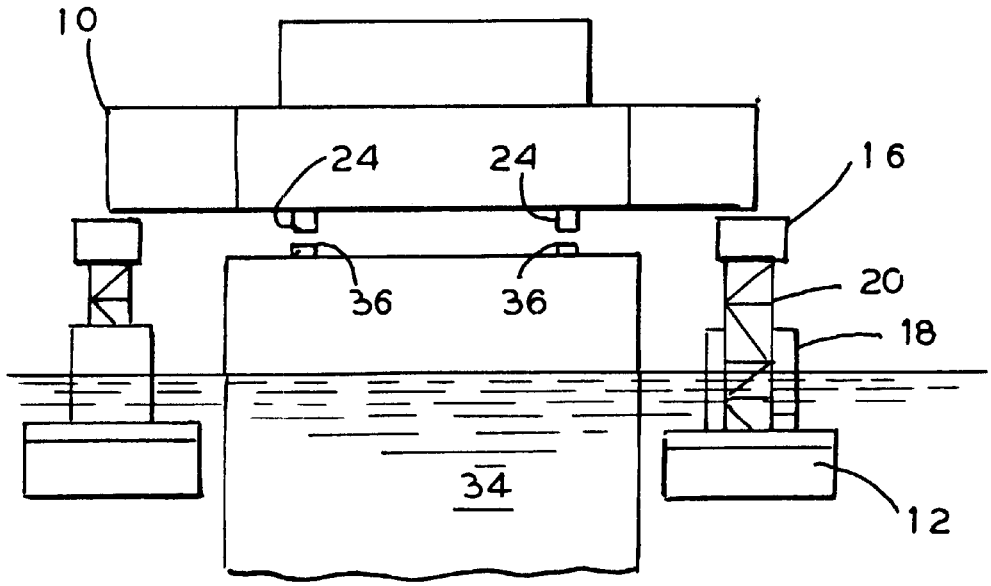
FIG. 7 illustrates the approach to the substructure.
Figure 8:
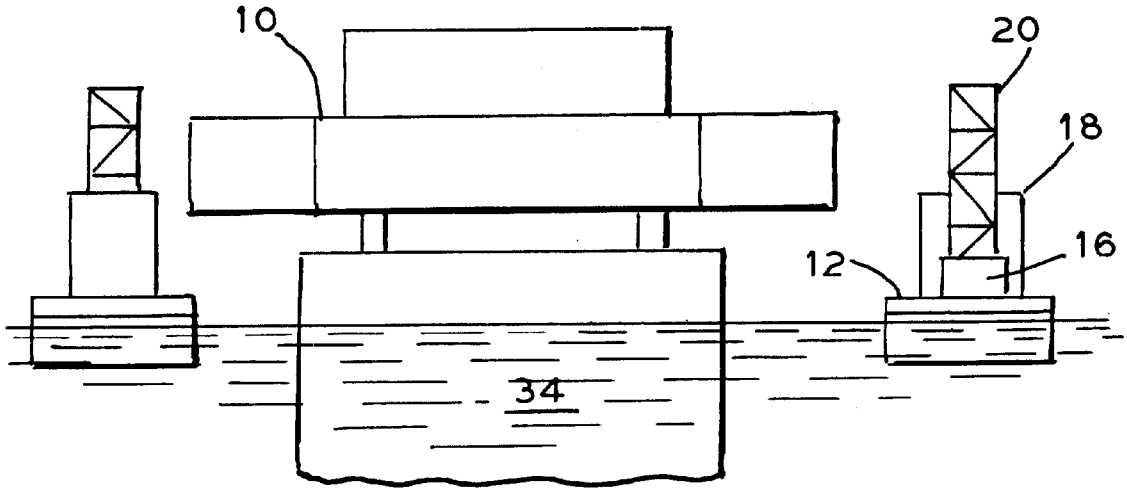
FIG. 8 illustrates the deck being lowered onto the substructure.

FIG. 7 illustrates the approach to the substructure 34. The height of the deck 10 allows the stabbing points 24 to clear the substructure 34 and the deck set down points 36. The deck 10 is lowered onto the substructure 34 by reversing the pinions 26. This lowers the deck 10 and lifting girders 16 toward the substructure 34. As the weight of the deck 10 is transferred to the substructure 34, the pontoons 12 are relieved of the weight of the deck and then float free as seen in FIG. 8. The pontoons are deballasted and then towed back to an onshore site or may be transported on a barge or ship.

The inventive method offers several advantages over the present state of the art. The width of the pontoons is infinitely adjustable. The stability columns provide very effective dampening against the waves and during set down operations. The jacking system allows the deck unit to be raised to any height above water. The pinions can be reversed and the deck set down quickly. With the use of a third barge in between the pontoons, heavy decks can be towed out of restricted ports with ease. Since the deck raising and lowering rate can be kept high, the time span required to set the deck is short, thus allowing a shorter weather window to become acceptable. The method can also be used to salvage decks that have been installed to date by following a set of operations that is in reverse order of installation.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for transporting a deck at sea and installing the deck on an offshore substructure, comprising the steps of:

a. constructing the deck on a set of girders;

b. placing the deck and girders on at least two floating pontoons;

c. installing stability columns on the pontoons;

d. installing lifting towers on the pontoons, said lifting towers including means engaged with the girders for selectively lifting and lowering the deck and girders;

e. installing removable bracing between the deck and pontoons;

f. towing the pontoons and deck to a selected offshore site, wherein the pontoons are at the maximum water plane area;

g. removing the bracing between the deck and pontoons;

h. lifting the deck to a height that allows the deck to be moved over a substructure;

i. moving the deck over the substructure; and j. lowering the deck into contact with the substructure.

2. The method of claim 1, further comprising the step of ballasting the pontoons down while lifting the deck.

3. A method for removing a deck from an offshore substructure and transporting the deck to a different location, comprising the steps of:

a. providing two pontoons that are capable of being ballasted or deballasted to a desired draft;

b. placing a girder on each pontoon;

c. installing stability columns and lifting towers on the pontoons, said lifting towers including means that engage with the girders for selectively lifting and lowering the deck;

d. ballasting the pontoons to a draft that positions the girders at a level below the lower portion of the deck;

e. positioning the pontoons and girders under opposite sides of the deck;

f. deballasting the pontoons into contact with the deck whereby the pontoons and girders lift the deck from the substructure;

g. installing removable bracing between the deck and pontoons; and h. towing the pontoons and deck to a desired location, wherein the pontoons are at the maximum water plane area.

* * * * *